United States Patent [19]

Orangeo, Jr. et al.

[11] Patent Number: 4,655,377

[45] Date of Patent: Apr. 7, 1987

[54] APPARATUS FOR DISPENSING PERMANENT WAVE PROCESSING PAPER

[76] Inventors: Joseph Orangeo, Jr., 54 Venetian Dr., Lake Hopatcong, N.J. 07849; Kenneth Orangeo; Robert Orangeo, both of 57 Wall St., Rockaway, N.J. 07866

[21] Appl. No.: 761,034

[22] Filed: Jul. 31, 1985

[51] Int. Cl.[4] ..... B65D 85/672

[52] U.S. Cl. ..... 225/48; 132/36.2 B; 132/43 R; 428/906

[58] Field of Search ..... 225/48–50; 428/906, 537.5, 913; 132/36.23, 43 R

[56] References Cited

U.S. PATENT DOCUMENTS

| | | | |
|---|---|---|---|
| 2,270,240 | 1/1942 | Farrell . | |
| 2,314,932 | 3/1943 | Gossaux . | |
| 2,461,101 | 2/1949 | Winkel . | |
| 2,541,345 | 2/1951 | De Navarre et al. . | |
| 2,601,428 | 6/1952 | Bonneau . | |
| 2,792,843 | 5/1957 | Eppich . | |
| 2,811,159 | 10/1957 | Stanton . | |
| 2,823,444 | 2/1958 | Davies et al. | 428/906 X |
| 2,832,357 | 4/1958 | Powers . | |
| 2,885,112 | 5/1959 | Willat . | |
| 2,991,790 | 7/1961 | Bonilla | 132/36.2 B X |
| 3,082,922 | 3/1963 | Warp . | |
| 3,087,501 | 4/1963 | Rosmarin . | |
| 3,123,266 | 3/1964 | Jernigan . | |
| 3,137,424 | 6/1964 | Finn et al. . | |
| 3,227,340 | 1/1966 | Haley . | |
| 3,228,403 | 1/1966 | Pasternack . | |
| 3,237,826 | 3/1966 | Ringholz et al. . | |
| 3,311,278 | 3/1967 | Brandon . | |
| 3,419,201 | 12/1968 | Brandon . | |
| 3,516,587 | 6/1970 | Bjorklund . | |
| 4,130,228 | 12/1978 | Perrin . | |
| 4,403,622 | 9/1983 | Stahl | 132/43 R |

*Primary Examiner*—Frank T. Yost

*Attorney, Agent, or Firm*—Martha G. Pugh

[57] ABSTRACT

A strip of highly absorbent cellulose paper which has been treated to increase its wet strength, and to render it more tear resistant, is folded lengthwise, so that one layer of the fold is slightly wider than the other, providing a lip along the outer edge. The folded strip is then formed into a small roll which is accommodated in a hollow container so that the free end is pulled out in tangential relation to the roll. Embedded in the top of the container is a cutting edge disposed to cut off increments of any desired length when the strip is held in contact with the cutting edge.

8 Claims, 5 Drawing Figures

APPARATUS FOR DISPENSING PERMANENT WAVE PROCESSING PAPER

BACKGROUND OF THE INVENTION

This relates in general to methods and apparatus for preparing end papers suitable for the permanent waving process, and for a device for dispensing end papers of various length during the permanent waving process.

In order to facilitate the rolling of strands of hair on rollers during the permanent waving process, it has been the practice to roll the ends of the strands in pieces of specially processed paper, as they are wound in rollers. These bits of paper are customarily supplied to the user in the form of flat pieces of tissue, cut off to a uniform size, say, two by three inches. The pieces are then stacked in small, open-ended boxes, from which they are dispensed. The problem is that the separate strands of hair, even from the same head, tend to be of many different lengths and conditions. Therefor, it is sometimes necessary to use one or more strips to cover a single curl, especially when the hair is long. In other cases, this is inconvenient, and the individual curls are improperly covered. This makes the operation unsatisfactory and time consuming for the operator, and may produce a less than satisfactory result for the customer, as the uneven thicknesses of the paper layers may actually interfere with uniform absorption by the hair of the permanent waving solutions during the waving process.

SHORT DESCRIPTION OF THE INVENTION

Accordingly, it is the primary object of this invention to improve the permanent waving process, more particularly, by facilitating the work of the operator in wrapping strands of varied lengths on the rollers, and further, in providing for a more uniform application of both reducing and oxydizing agents to different lengths and types of hair.

These and other objects are achieved in accordance with the present invention by providing strips of specially treated paper which is highly absorbent and tear resistant, and which has a a high wet strength, dispensed from rolls encased in a container having a knife-edge, so that the pieces can be cut off to any desired length. As a further feature, the dispensed strips are prefolded with one layer being uniformly wider than the other along its length, providing a lip which extends along the outer edge and can be readily grasped by the operator to open the fold and place the strands of hair inside, thereby providing an envelope which holds the strands together, and protects the ragged ends as they are wound onto the roller. The waving fluid initially applied is usually a reducing agent, such as sodium ammonium thioglycolate. Because the strands are wrapped uniformly in an envelope providing a protective layer to the ends, and holding them in place, regardless of their lengths, the waving fluid is more evenly applied to the individual strands, regardless of their lengths. After the hair so saturated with waving fluid has been allowed to stand for a required period, which varies according to the solution used and the condition of the hair, an oxydizing agent is applied, which may be, for example, an aqueous solution of sodium perborate, boric acid, tartaric acid, and carbowax. This neutralizes the waving fluid, stopping its reducing action. Again, the protective absorbent paper envelope in which the ends are wrapped uniformly, in accordance with the present invention, permits the reducing agent to contact the ends uniformly, preventing over-action on some pieces of hair, such as broken ends, and under-action on others. This provides a more uniform curling action on the overall head of the customer.

The particular advantageous features of the present invention are that it greatly facilitates the work of the operator, as he or she grasps and tears off just the right length of paper from the dispenser for wrapping a particular piece of hair on a roller, folding it into an envelope formed by the double layers, so that the loose ends are held in place and completely covered during the winding process and application of the permanent waving fluids. This protects the ends, and facilitates uniform action of the chemical fluids during the waving process.

These, and other objects, features and advantages of the invention will be better understood by a study of the detailed specification hereinafter with reference to the attached drawings.

SHORT DESCRIPTION OF THE DRAWINGS

DETAILED DESCRIPTION OF THE INVENTION

Figure 1:
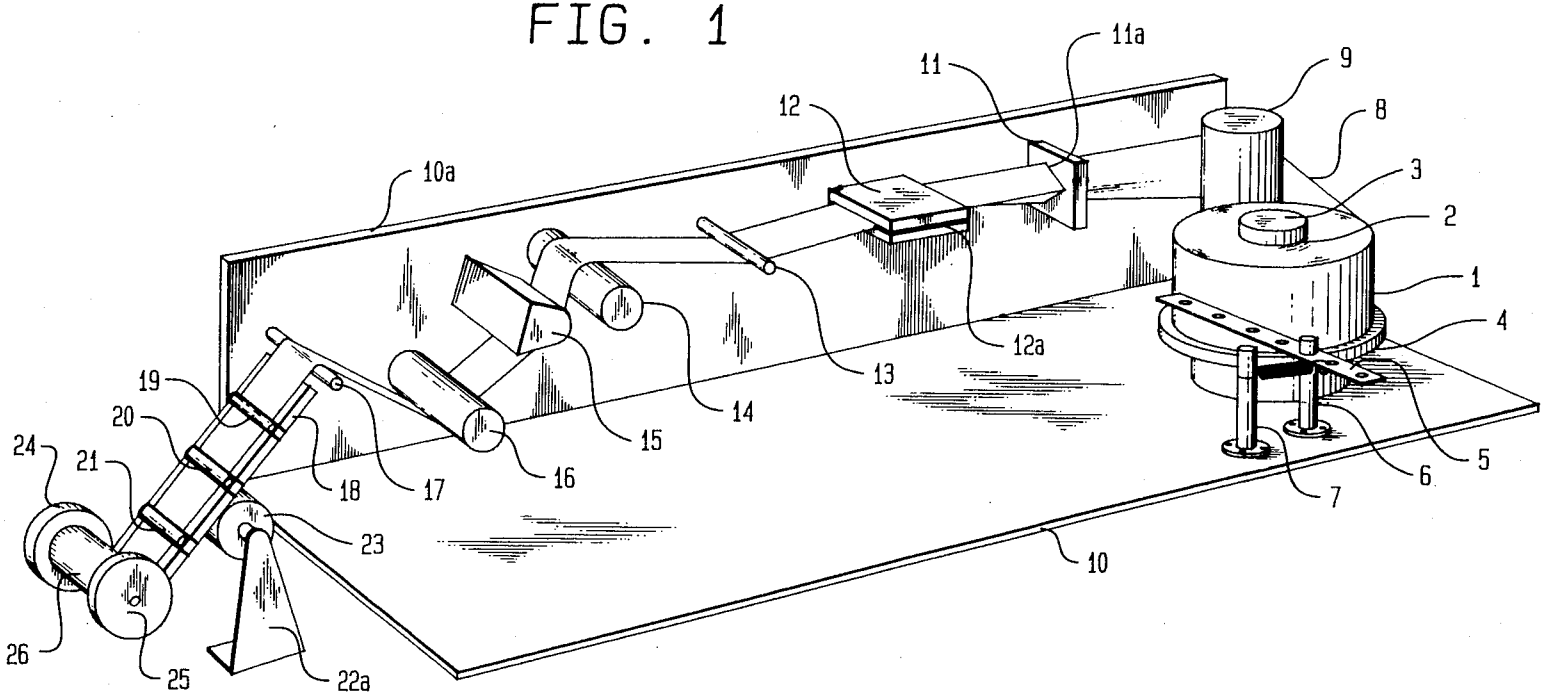
FIG. 1 shows a system for folding and forming rolls of permanent waving end paper for use in dispensers in accordance with the present invention.

Referring in detail to FIG. 1, there is shown a system for winding rolls of permanent waving end paper in accordance with the present invention.

A special type of highly absorbent paper having a high wet strength, and high tear-resistance when wet, is used for the purpose of enveloping and wrapping the cut and broken end strands of hair as it is applied to rollers during the permanent waving process. The paper used for this process is a high purity cellulose paper comprising a wood-pulp base, having a basic weight which may approximate, for example, 16 grams per square meter. It is treated to increase its wet strength and tear resistance by impregnating it with a suitable resin, such as, for example, melamine, or urea formaldehyde, giving it a wet strength sufficient to withstand a tension of, say, 50 grams applied to each half-inch strip. In the case of lanolized products, additives are included, such as, for example, five percent by weight of lanolin and three percent by weight of reaction product of ethylene oxide and lanolin with sorbitol, as set forth in U.S. Pat. No. 2,832,357, issued to Donald H. Powers, Aug. 29, 1958, which is incorporated herein by reference. End paper suitable for the purposes of the present invention is similar to certain types of paper used in the manufacture of cigarettes. It has a thickness not exceeding, say 0.02 inch, and is available in the market either in perforated or unperforated form, and either plain, or lanolized and tinted. The lanolized tinted perforated papers aid in buffering the waving solution to prevent hair end damage. It is customary to use a yellow tint in the lanolized types to provide the user with confidence that lanolin is present. The plain perforated papers are exceptionally well suited to the thicker types of hair, aiding penetration of the waving lotion and neutralizer.

An important feature of paper suitable for the purposes of the present invention is its porosity. For example, the non-perforated types are preferably characterized by a Filtrona Pressure Drop of between 14.1 (optimum) and 24.2 (maximum), where this term is defined as the number of millimeters of water passing through a layer in response to a flow rate of 17.5 cubic centimeters per second.

For the purposes of the present invention, permanent waving end paper of the foregoing types may be obtained initially in a roll having an outer diameter of, say, 38 to 40 inches, and having a total length of, say 50 feet, which is wound on a spool having an inner core diameter of, say, 4–23/32 inches. For present purposes, each roll is cut to a length of, say, four inches in an axial direction.

The spool or core of the roll 1 is accommodated on a rod 3 which extends up vertically in fixed relation to a round pedestal 4. The roll 1 is held in place by one end of the tangentially-extending doctor-blade 5. The latter is a metal blade rotatably mounted on the vertical post or stud 6, so that one end bears against the roll 1 and the other end is spring-biased to the adjacent post or stud 7.

The four-inch wide strip or webb 8 passes from the outer periphery of the roll 1 as the latter unwinds, making substantially a 90 degree angular turn as it passes part way around the 2 inch diameter post 9, which projects up vertically from the supporting surface 10. The center of the post 9 is spaced-apart a lateral distance of, say, 8½ inches from the center of the rod 3. The strip or webb 8, which is substantially flat in the vertical plane as it moves away from the surface of the post 9, next moves in a direction normal to the guide 11, where it passes through a V-shaped opening 11*a* in the guide 11. The latter, which is spaced about 9 inches from the center of post 9 in a horizontal direction, comprises a rectangular solid block of wood or plastic, or other solid material, say 3½ inches by 3½ inches in a vertical plane, and ¾ inch thick, being supported edgewise from the vertical supporting wall 10*a*. The V-shaped slot 11*a* is cut through the thickness of the block 11 in a direction normal to its principal surfaces, forming an angle of approximately 45 degrees between the two legs, the lower leg being about 2⅛ inches long, and the upper leg being about 1⅞ inches long. The slot 11*a* provides a vertical clearance of about ¼ inch, which accommodates one layer of the strip or webb 8, which is threaded through the two legs of the slot, in a direction normal to the surfaces of guide 11, so that a slightly uneven fold is imposed upon it as it passes through.

The partially folded strip or webb 8 then passes a distance of about 4 inches from the outer surface of the angular guide 11 to the inner edge of the sandwich-shaped guide 12. The latter comprises a pair of substantially identical rectangular blocks, say, 4 inches by 3 inches in a horizontal plane, and ½ inch thick, supported to project in a normal direction from the side wall 10*a*, being uniformly spaced-apart a distance of, say, 1/16 inch, providing a slot which accommodates and confirms the fold in the strip or webb 8. The folded strip or webb 8 subsequently passes under the rod 13, which is spaced a distance of about 10½ inches from the outer edge of sandwich-shaped guide 12. The rod 13, which is ½ inch in diameter, projects in a normal direction from the side wall 10*a*, in a vertical position which is just below the lower edge of sandwich guide 12, so as to apply tension to the webb or strip 8, and hold the fold flat as it passes along.

The webb or strip 8 then passes over the 2 inch diameter roller post 14, which projects out normally from the vertical side wall 10*a*, centered at a distance 7½ inches from the center of rod 13, so that the webb or strip 8 changes its direction of transverse through a negative angle slightly exceeding 90 degrees as it passes over post 14. The conventional counter 15, having a wheel which rides against the webb or tape as it passes off of the top of the cylindrical post 14, operates to measure the footage of the passing tape. The direction of the folded webb or strip is again changed as it passes under the 2 inch diameter post 16, which projects out from vertical side wall 10*a*. Post 16 is centered 6½ inches in a lateral direction and 5 inches below the center of post 14, causing the webb or strip 8 to again change direction through an upward angle of about 135 degrees with its former direction, as it passes over the outwardly projecting rod 17, which is similar to rod 13, and is centered 6½ inches in a lateral direction and 4 inches above the center of post 16.

For the last lap of its journey, the folded webb or strip 8 passes downward at an angle of about 45 degrees with the vertical, supported by a flat trough or carrier 18. This may, for example, comprise an oblong piece of metal or plastic, spaced-apart on the upper surface of which, at intervals of about 3 inches, are three rollers, 19, 20 and 21, fastened transversely across the trough, so that the webb or strip 8 is held flat as it passes beneath them. The trough or carrier 18 rests tangentially against a 2 inch diameter roller 23 which is suspended axially between a pair of supports 22*a* and 22*b* (not shown).

The end of the webb or strip 8 passes under and around the spool 26 which is co-axially coupled to a shaft which is motor-driven by a ¼ horsepower motor (not shown) to rotate at speeds which may be varied, the shaft being mounted in the bearing members 24 and 25.

When a predetermined length of the webb or strip 8 has been wound on the spool 26, the weight automatically operates a micro-switch in the driving circuit of the motor, causing the motor to stop, in a manner well-known in the art. Once the motor stops, the bearing member 25 is unlatched, releasing the filled spool 26, which is stripped off of the motor shaft, and replaced for the next run.

Figure 2:
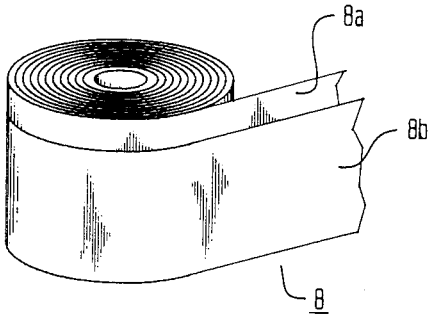
FIG. 2 is an enlarged showing of a roll of folded permanent waving end paper in accordance with the present invention.
Figure 3:
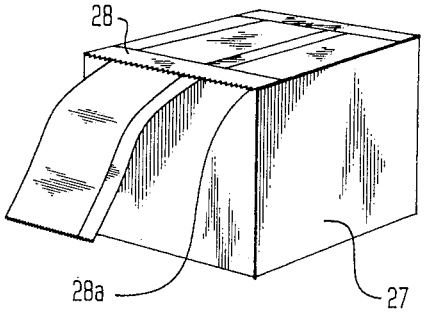
FIG. 3 shows the roll of FIG. 2 mounted in a dispenser having a knife edge.
Figure 4:
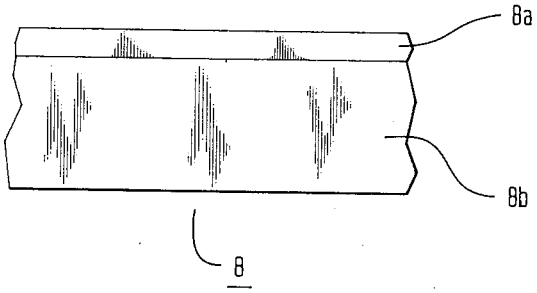
FIG. 4 shows a piece of permanent waving end paper which has been torn off to a desired length in accordance with the present invention.

As shown in FIG. 2, the completely wound spool 26, which has been removed from the spool-wrapping machine, includes, for example, 50–100 feet of paper webb or strip, folded, so that the under layer 8*a* extends 2⅛ inches from the folded edge, and the upper layer 8*b* extends 1½ inches from the fold, leaving a lip ¼ inch wide along the length of the under layer for convenience in grasping and opening the folded strip. The roll 1, such as shown in FIG. 2, which may vary in size as demanded by convenience, is interposed into a hollow rectangular container 27, as shown in FIG. 3. In the present example, this box is formed of paper or plastic, say 1/16 inch thick, to give it rigidity, and is preferably rectangular in form, 2¾ inches, by 2¾ inches, and 2 inches deep. In the present example, a slit 28 is centered so that it extends transversely across the top. It is provided with a knife edge 28*a* which is 2¾ inches long and ½ inch wide, and may be cerrated to facilitate cutting. The knife 28*a* is preferably of metal, such as stainless steel, but may also be formed of rigid plastic. The end of the strip 8 is pulled out through the slit 28 in tangential relation to the roll which unrolls as the paper is pulled away from the box.

Figure 5:
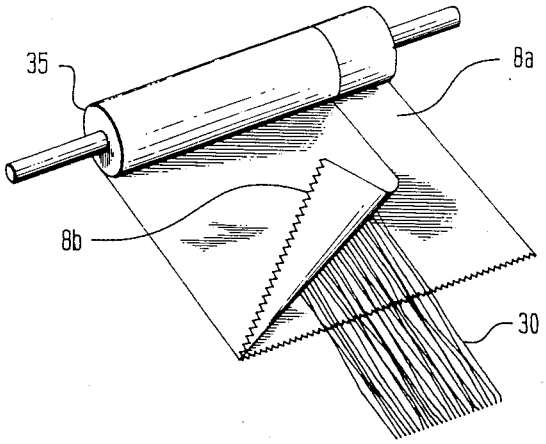
FIG. 5 shows a piece of hair in the process of being interposed between the folded layers of a piece of permanent waving end paper, torn to the desired length, prior to being wound on a typical permanent waving roller.

During the permanent waving process, the head of hair of the customer is divided into sections, each strand or section of hair being wound separately. The strands or sections may be of different lengths and conditions. The end of the folded strip 8 is grasped by the operator, and pulled away from the box 27 to the desired length and then pulled back against the knife edge 28*a* to sever it. Grasping the lip of the wider layer 8*a*, the upper layer 8*b* is folded back, as shown in FIG. 5 so that the operator may insert the ends of a strand or section of hair to be processed between the layers 8*a* and 8*b*, being then rolled up on a conventional wooden roller 35, and pinned in place. After the whole head has been processed in this way, and all of the rollers have been fastened in place, the head is saturated with a permanent waving solution. This conventionally comprises a reducing agent, such as, for example, a 5.5 percent solution of sodium ammonium thioglycolate (approximately equal moles of sodium and ammonium thioglycolate, pH 9.2) as disclosed in U.S. Pat. No. 2,832,357, issued to Donald Powers Aug. 29, 1958, or any other of the permanent waving solutions well-known in the art. In an alternative method, the hair may be saturated with a permanent waving solution prior to wrapping it in the paper envelopes and applying it to the rollers.

After the hair is on the rollers, and has been completely saturated, the waving solution (reducing agent) is allowed to remain on the hair for a preselected period, say, 10 minutes, which will be dictated by the strength and character of the waving solution and the type and condition of the hair. The hair may be saturated again before the end of the period.

At the end of the period, with the rollers and end papers still in place, the hair is again saturated with a neutralizer, which is usually an oxydizing agent. This may take the form, for example, of an aqueous solution of sodium perborate, boric acid, and tartaric acid including a small amount of carbowax 600, of the composition disclosed in U.S. Pat. No. 2,832,357 supra, or an oxydizing solution of one of the other compositions well-known in the art.

It will be apparent that inasmuch as the permeable paper layer comprising the end wrap layer of the present invention surrounds the strands or sections of hair during the entire operation described, in which the hair is saturated several times with chemical solutions, the evenness and thickness of the paper layer is one of the factors which determines the uniformity of the chemical action on the hair under treatment, and the ultimate result in the success or failure of the permanent waving process.

It will be understood that the present invention is not limited by any of the structures or methods of operation specifically described herein by way of example, but only by the scope of the appended claims.

What I claim is:

1. A kit for dispensing increments of end paper for use in connection with a permanent waving process, which comprises in combination:

a container comprising a hollow body portion which body portion is closed except for a straight-edged opening at or near the top of said body portion, said opening comprising a cutting edge;

a continuous cylindrical roll of permanent waving end paper disposed in said container and having one end of said roll extended tangentially to the surface of said roll in partly unrolled relation to said roll, and constructed to extend out of said container and to pass over said straight edge opening in transverse relation to said cutting edge, whereby when manual tension is applied to said end a piece of a desired length is severed from said roll;

said permanent waving end paper comprising an absorbent paper of high purity cellulose having a wet strength sufficient to withstand a tension of at least about 50 grams applied to each half inch wide strip, and having a porosity characterized by a Filtrona Pressure Drop of between 14.1 and 24.2 millimeters of water.

2. The combination in accordance with claim 1 wherein said end paper comprises a wet strength resin such as melamine or urea formaldehyde.

3. A kit in accordance with claim 1 wherein said roll comprises a strip of end paper folded along its length, forming a pair of layers, one of which is slightly wider than the other between the fold and the edge, providing a single layer lip along one edge for facilitating the opening of said folded strip which is torn off to a desired length.

4. A kit in accordance with claim 3 wherein the wider of said folded layers is about 2½ inches wide between said fold and said edge, and the narrower of said layers is about 1½ inches wide between said fold and said edge, providing a single layer edge along the length of said strip about ¼ inch wide.

5. The subcombination comprising a continuous cylindrical roll of permanent having end paper, one end of said roll extended tangentially to the surface of said roll constructed in partly unrolled relation of said roll to extend outward in transverse relation to a cutting edge, whereby when manual tension is applied to said end, a piece of a desired length of said permanent waving end paper is severed from said roll;

said permanent waving end paper comprising an absorbent paper of high purity cellulose having a wet strength sufficient to withstand a tension of at least about 50 grams applied to each half inch wide strip, and having a porosity characterized by a Filtrona Pressure drop of between 14.1 and 24.2.

6. A roll of permanent waving end paper in accordance with claim 5 wherein said end paper comprises a wet strength resin such as melamine or urea formaldehyde.

7. A roll of permanent waving end paper in accordance with claim 5 wherein said roll comprises a strip of end paper folded along its length, forming a pair of layers, one of which is slightly wider than the other between the fold and the edge, providing a single layer lip along one edge for facilitating the opening of said folded strip which is constructed to be torn off to a desired length.

8. A roll of permanent waving end paper in accordance with claim 7 wherein the wider of said folded layers is about 2⅛ inches wide between said fold and said edge, and the narrower of said layers is about 1⅞ inches wide between said fold and said edge, providing a single layer edge along the length of said strip about ¼ inch wide.

* * * * *